US005220539A

United States Patent [19]

McDuffee

[11] Patent Number: 5,220,539

[45] Date of Patent: Jun. 15, 1993

[54] BIBLICAL TIMEPIECE HAVING IMPROVED DISPLAY CHARACTERISTICS

[76] Inventor: Samuel E. McDuffee, 37 Metate, Pinon Pines Estates, Kingman, Ariz. 86401

[21] Appl. No.: 872,974

[22] Filed: Apr. 24, 1992

[51] Int. Cl.[5] ..... G04B 19/24; G04B 19/04

[52] U.S. Cl. ..... 368/28; 368/80

[58] Field of Search ..... 368/28, 31-38, 368/61, 76, 80, 82, 223, 228

[56] References Cited

U.S. PATENT DOCUMENTS

| | | | |
|---|---|---|---|
| 2,044,808 | 6/1936 | Povelsen | 368/28 |
| 3,628,322 | 12/1971 | McDuffee | 368/28 |
| 4,236,240 | 11/1980 | Yoshida | 368/76 |
| 4,972,393 | 11/1990 | Sase et al. | 368/28 |

*Primary Examiner*—Vit W. Miska

[57] ABSTRACT

A timepiece for displaying both Biblical and conventional time wherein the dial face is provided with a twenty-four hour track adjacent to and aligned with a night watch track to provide concurrent reading of the Biblical hour and the Roman hour. A concentric one hour track is provided to permit display of minutes. A pair of sweep hands continually indicates both times.

4 Claims, 1 Drawing Sheet

BIBLICAL TIMEPIECE HAVING IMPROVED DISPLAY CHARACTERISTICS

BACKGROUND OF THE INVENTION

This invention relates to timepieces which display both Biblical and Roman time and, in particular, to a timepiece wherein the time of day reference tracks are oriented on the dial so as to enable the observer to concurrently view both times with the assistance of a single pair of sweep hands.

The system of time keeping established in the Bible differs from the secular or Roman time keeping system in use today. The basis for the Biblical system calls for the start of each evening to begin a new day. It is the evening hour of six that signifies the start of the first portion of each day. The evening half of the day is stated in the Bible to be divided into four distinct watches which are referred to by their numerical order of occurrence. As a result, the transition from second to third watch coincides with the conventional 12 o'clock midnight hour. The end of the fourth watch signifies the midpoint of the Biblical day and coincides with the six o'clock morning hour of Roman time.

The ability of one living in the secular world to quickly and accurately determine both the present Biblical and present Roman times is important in the conduct of many peoples lives. A Biblical timepiece having the capability of displaying both times is described in my U.S. Pat. No. 3,628,322, granted Dec. 21, 1971 and entitled Biblical Timepiece. The timepiece disclosed therein utilizes the conventional 12 hour and 60 minute time of day reference tracks along with the associated sweep hands in combination with four adjacent reference tracks. The additional tracks display the Biblical time, day of the week and date. To accomplish the display of both Biblical and Roman time, a total of six hands are employed in this timepiece with each of these hands being rotated about a common central axis. While the information displayed is complete and accurate as to Biblical and Roman times, the number of reference tracks that use a sweep hand with each track requires that careful attention be paid by the viewer when reading the timepiece. A viewer merely glancing at the timepiece rather than taking the time to carefully analyze the position of each hand and its relationship to a single reference track was likely to misread the time if he failed to exercise sufficient care.

The Biblical timepiece described in my patent noted above utilized a conventional 12 hour reference track thereby requiring a number of separate hands for the Biblical and Roman times. In addition, the time scale for both the Biblical and Roman reference tracks swept by the hands differed in that the divisions for equal periods of elapsed time subtended different angles. As a result, the reference tracks were not capable of angular alignment thereby increasing the difficulty in accurately viewing the timepiece.

Accordingly, the present invention is directed to a timepiece which facilitates the reading of both Biblical and Roman time by the use of a common pair of sweep hands. Also, the invention contains concentric reference tracks calibrated in both time systems and oriented to enable the times in one system to be readily converted into the other system without changing the viewing reference point on the timepiece. Furthermore, this timepiece enables the calibrated reference tracks to be oriented so that the start of each Biblical day is in alignment with the corresponding hour of Roman time.

The unique construction and calibration of this timepiece reduces the number of sweep hands to two in contrast to the multiplicity of hands heretofore used to display both Biblical and Roman time in a single timepiece.

SUMMARY OF THE INVENTION

This invention relates to a timepiece for keeping and displaying both Roman and Biblical time wherein the timepiece housing has a dial face which includes three adjacent concentric reference tracks thereon. A nightwatch track is provided which is divided into the four segments of the evening and disposed in a semi-circular trace on one half of the dial face. A one day track divided into equal segments is placed adjacent the watch track. A one hour track divided into equal segments completes the sequence of three reference tracks. The timepiece includes two primary sweep hands. The first is a nightwatch hand rotationally mounted to sweep the dial face once each twenty-four hour period. Also, a one hour sweep hand is rotationally mounted to sweep the dial face once each hour. While the nightwatch track contains the four evening watches referred to in the Bible as comprising one half of a day, the track is preferably completed by denoting additional three hour segments which completes the Biblical time track for a day.

A thirty day reference track is located on the dial face, but is preferably not concentrically aligned with the nightwatch, one hour and one day tracks. A separate day indicating hand sweeps the thirty day track in response to a drive mechanism located in the timepiece housing. Since a Biblical month may consist of either 29 or 30 days, this drive mechanism is separately adjustable to permit the user to adjust the day of the month independently of the time display. The housing also contains a drive mechanism which imparts rotation to the two hands that sweep the three concentric time reference tracks.

In preferred embodiments of the invention, a digital display for indicating the current time of day according to conventional or Roman time is located in the dial face. The digital display is provided with a separate drive mechanism independent of those of imparting rotation to the nightwatch and one hour sweep hands and the day indicating hand which sweeps the separate thirty day track. The incorporation of this digital display provides the wearer with an immediate view of conventional time without regard to the combination of concentric tracks.

One important feature of the present invention is that the nightwatch track and the one day track are oriented so that the hours of each time system are mutually aligned. Thus, the start of the evening which occurs at first watch according to the Bible is adjacent that portion of the one day track indicating six o'clock. In addition, the reference tracks are oriented so that the midnight hour and the Biblical equivalent which marks the passage from second watch to third watch which coincide are located at the top of the dial face when the timepiece is viewed normally. As a result, the user can replace his existing conventional watch with the present invention without altering his traditional frame of reference when viewing the dial face.

Further features and advantages of the present invention will become more readily apparent from the following detailed description of a preferred embodiment when taken in conjunction with the accompanying drawings.

DESCRIPTION OF THE PREFERRED EMBODIMENT

Figure 1:
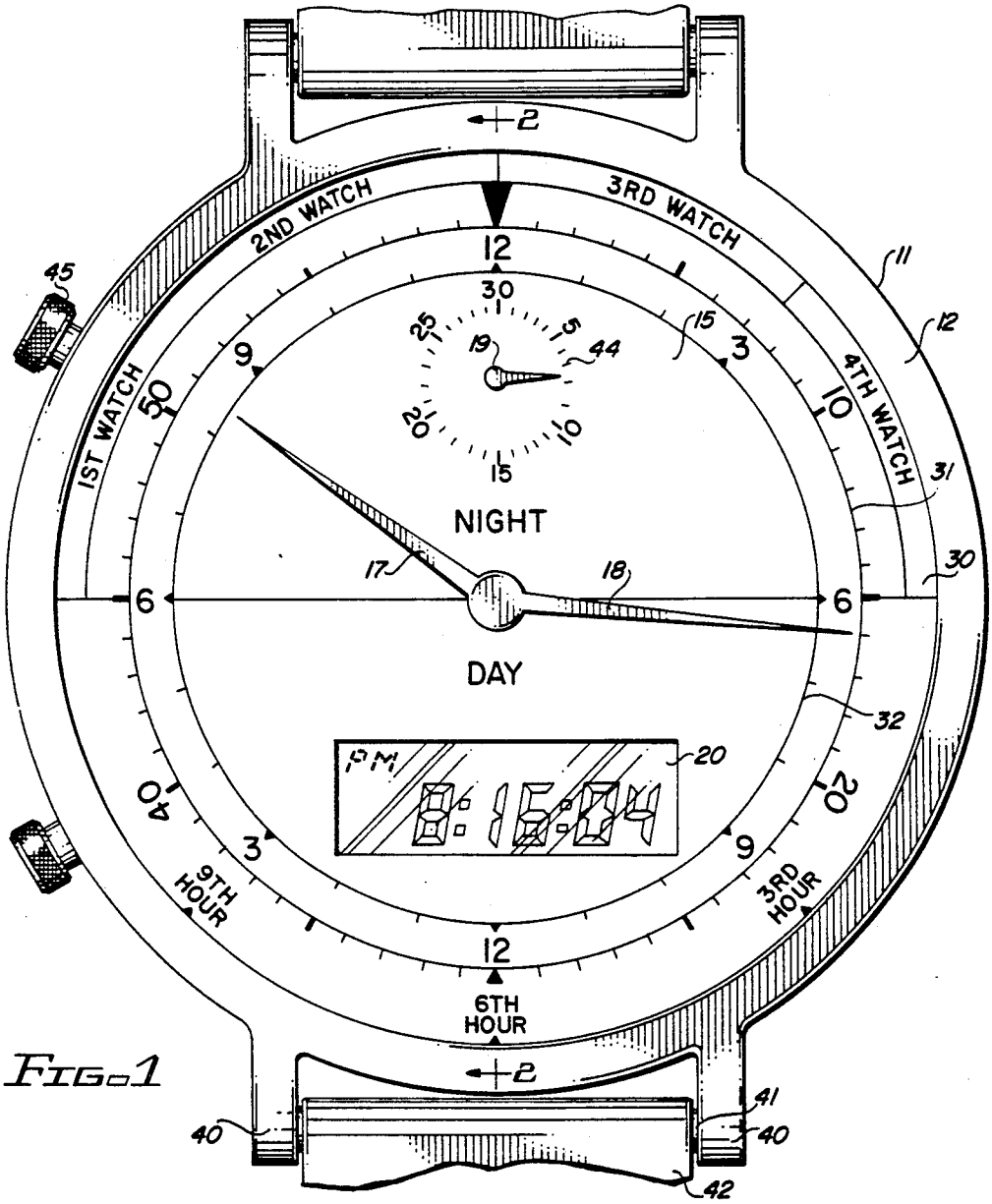
FIG. 1 is a plan view of a preferred embodiment of the Biblical timepiece of the present invention.
Figure 2:
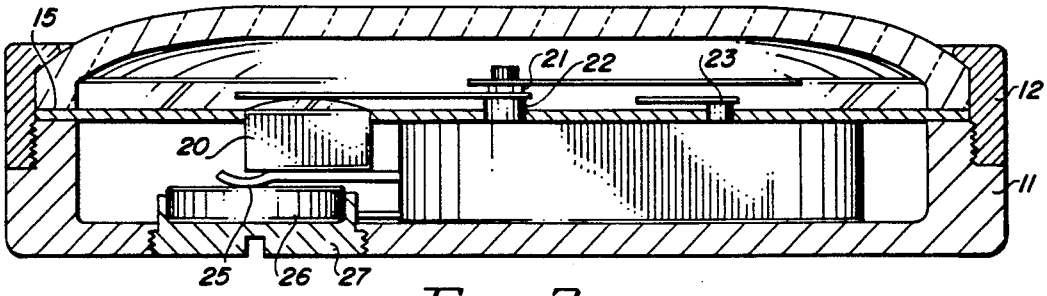
FIG. 2 is a cross-sectional view showing the orientation of the sweep hands taken along line 2—2 of FIG. 1.

Referring now to FIG. 1, the timepiece which is the subject of the present invention includes a housing 11 which provides the cavity for the receipt of the drive mechanisms for the sweep hands and digital display of the timepiece. As shown in FIG. 2, the housing 11 receives a bezel or threaded rim 12 which secures a transparent protective crystal 14 across the top surface of the timepiece. A dial face 15 extends across the cavity formed by the housing and is held in position by the combination of crystal 14 and bezel 12. The timepiece includes three hands, two of which are concentrically mounted about a central axis. These two concentrically mounted hands 17 and 18 are mounted on tubular shafts 21 and 22 respectively for connection to a conventional timepiece drive mechanism. The third hand 19 is laterally disposed from hands 17, 18 and is connected by tubular shaft 23 to its drive mechanism. In this embodiment, a digital display 20 is provided in the dial face in the lower half of the timepiece. The digital display is a self-contained unit available commercially and provided with its own electrical drive mechanism as shown generally in FIG. 2.

The dial face 15 has three concentric adjacent reference tracks located in its outer peripheral region. The outer track 30 contains a graduated display of the Biblical watches of the evening ranging from first watch through to fourth watch. This nightwatch track is disposed in a semicircular trace. The remaining hour of the Biblical day then continues on in this reference track by the third hour, sixth hour and ninth hour notations displayed in the lower half of the dial face. Inwardly adjacent to the nightwatch track is a one hour track 31 divided into sixty segments. The innermost reference track is the one day track 32 shown divided into 24 equal hourly segments. Track 32 is labeled so that the diametrically opposed pair of numerals 12 are oriented at the top and bottom of the track.

The two sweep hands 17 and 18 are centrally mounted for rotation on the face so as to sweep the reference tracks during operation with the larger hand 18 making one complete rotation every sixty minutes thereby providing an accurate indication of the minutes on one-hour track 31. The smaller of the two sweep hands is the hour hand 17 as is customary with conventional timepieces. This hand completes one full rotation every twenty-four hour period. As a result, the one day reference track has the numerical hour sequence, one through twelve, repeated twice thereon. since Biblical time is displayed by utilizing the nightwatch track 30 in combination with the one hour track 31, the two sweep hands 17 and 18 accurately depict Biblical time and conventional or Roman time concurrently. Unlike prior Biblical timepieces which are characterized by different hands sweeping different tracks, only a single pair of sweep hands need to be consulted to accurately and readily view time in each system.

As mentioned previously, the Biblical day begins at the conventional hour of six in the evening. To facilitate an accurate reading of Biblical time, the nightwatch reference track is oriented so that the viewer sees the transition between second watch and third watch at the top of the dial. The long-standing custom of having twelve o'clock in this position causes viewers to often use this as a first reference point when glancing at a timepiece. To assist the viewer relying on the present invention, the legends night and day are displayed in central locations in the respective semicircular portions of the dial face as shown in FIG. 1. Placed diametrically opposed from the start of the Biblical day which corresponds to the conventional time of six o'clock in the evening, the dial face displays the end of the fourth watch which corresponds to six o'clock in the morning. The daytime hours are displayed in the lower semicircle of the dial face for both Biblical and Roman time.

As shown in FIG. 1, the preferred embodiment is a wrist watch wherein the housing is provided with two pairs of tabs 40. Each pair receives a removable pin 41 therebetween. A typical wrist strap 42 is placed on the pins 41 to support the timepiece. However, it is to be noted that the subject of the present invention can be utilized for watches of different configuration or clocks that stand alone.

The dial face is provided with a thirty day reference track 44 which is swept by a centrally located hand 19. The hand 19 advances one segment every twentyfour hours to provide a numerical day of the month indication to the viewer. Since the Biblical month may contain either 29 or 30 days, a separate setting knob 45 is provided at the outer edge of the housing 11 to enable adjustment to be made when necessary. This Biblical calendar feature can of course be set to the Roman day of the month or to the Biblical day of the month should they diverge in any given period. This dial displays information under the separate control of the user even though the drive mechanism may be linked with or geared from the mechanism driving hands 17 and 18.

As mentioned previously, a digital display 20 is contained in the housing 11 and its display face becomes part of the dial face. The digital display is typically a liquid crystal display with conventional alpha-numeric segments and powered by a battery contained within the housing 11. This battery can be used to power the mechanism driving the sweep hands. In FIG. 2, the display 20 is shown in the cross-sectional view with an electrode structure 25 contacting a button battery 26. The button battery can be removed and replaced by use of the plug 27 formed in the underside of the housing. A variety of different means of providing access to the watch housing can be employed. The digital display is a reference feature since it will provide not only actual hour, minute and second, but also whether the time is am or pm. Furthermore, the use of the minute and second counter adds versatility to the timepiece since it enables one to readily determine short elapsed times.

Referring to FIG. 2, the mechanism which imparts the rotation to shafts 21, 22 and 23 is a conventional watch drive mechanism and the hands may be frictionally mounted on the shafts for rotation therewith. The gearing arrangement contained within the drive mechanism for hands 17, 18 and 19 is conventional with the drive ratios between adjacent shafts being chosen for the corresponding periods of revolution. In one embodiment of the invention tested and operated over a long period, the twenty-four hour hand 17 and the one hour hand 18 were driven by a mechanism manufactured by Citizens Watch Co. of Tokyo, Japan. The thirty day hand 19 was driven by a mechanism manufactured and sold by Xanadu Watch Company of Hong Kong and the liquid crystal display used was a commercially available product from the Citizens Watch Co.

During operation of the timepiece, the orientation and proximity of the nightwatch track and one-hour track enable the viewer to quickly determine the Biblical hour of the day, the watch of the evening and the Roman hour of the day from a single pair of sweep hands. The one hour track is conventionally labeled in minutes and interposed between the two tracks in the preferred embodiment. The day of the Biblical month is quickly determined by viewing hand 19 and its position relative to track 44. As a result, the viewer can quickly and accurately determine both Biblical and Roman time with little likelihood of error and confusion. The multiplicity of hands heretofore used to simultaneously display these times was found to promote uncertainty in the viewer and careful attention to avoid errors. The simplified display and unique orientation herein substantially reduce the likelihood of error and promote confidence in the device as a unique timepiece displaying both Biblical and Roman time.

While the above description has referred to a specific embodiment of the invention, it is to be noted that variations and modifications may be made therein without departing from the scope of the invention as claimed.

I claim:

1. A timepiece having two sweep hands which display both current time and Biblical time which comprises:

a) a timepiece housing having a dial face thereon, said dial face including i. a night watch track divided into four equal segments and disposed in a semicircular track on one-half of said dial face;

ii. a one hour track divided into equal segments and disposed in a circular track on said dial face;

iii. a one day track divided into equal segments having a start of day indicator thereon, and disposed in a circular track on said dial face; said night watch track, one hour track and one day track are concentrically positioned on said dial face with said start of day indicia located in alignment with the midpoint of the night watch track.

b) a night watch hand rotationally mounted to sweep said dial face once each twenty-four hour period;

c) a one hour hand rotationally mounted with said night watch and day time hand to sweep said dial face once each hour; and d) a first drive mechanism located in said timepiece housing for imparting rotation to said night watch and one hour hands.

2. The invention in accordance with claim 1 further comprising:

a) a thirty day track located on said dial face and divided into thirty equal segments;

b) a day indicating hand sweeping said thirty day track, and c) a second drive mechanism located in said timepiece housing for imparting rotation to said day indicating hand.

3. The invention in accordance with claim 2 wherein said thirty day track is located on said dial face within said concentrically positioned tracks.

4. The invention in accordance with claim 3 wherein said timepiece further comprises a digital display for indicating the current time of day, said display including a third drive mechanism.

* * * * *